US007137146B2

(12) United States Patent
Yan

(10) Patent No.: US 7,137,146 B2
(45) Date of Patent: Nov. 21, 2006

(54) VERSATILE VISOR CAP

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 0 days.

(21) Appl. No.: 11/043,528

(22) Filed: Jan. 25, 2005

(65) Prior Publication Data

US 2006/0162037 A1 Jul. 27, 2006

(51) Int. Cl.
*A61F 9/00* (2006.01)

(52) U.S. Cl. ..... 2/12; 2/209.12

(58) Field of Classification Search ..... 2/10, 2/12, 209.11, 209.12
See application file for complete search history.

(56) References Cited

U.S. PATENT DOCUMENTS

| | | | | |
|---|---|---|---|---|
| 129,194 | A * | 7/1872 | Wilks | 2/209.11 |
| 1,677,187 | A * | 7/1928 | Leibson | 2/10 |
| 4,724,546 | A * | 2/1988 | Cumbie, Jr. | 2/12 |
| 5,091,995 | A * | 3/1992 | Oates | 2/209 |
| 5,253,364 | A | 10/1993 | Robinson | 2/10 |
| D367,158 | S | 2/1996 | Baker | D2/882 |
| 5,669,071 | A | 9/1997 | Vu | 2/10 |
| 5,689,830 | A | 11/1997 | Pflum | 2/195 |
| 5,896,587 | A | 4/1999 | Gentry | 2/425 |
| 5,898,935 | A | 5/1999 | Davis | 2/10 |
| 5,996,125 | A | 12/1999 | Garzone | 2/410 |
| 6,081,922 | A * | 7/2000 | Wright | 2/12 |
| 6,088,837 | A | 7/2000 | Baker | 2/195.1 |
| 6,237,156 | B1 | 5/2001 | Ellman et al. | 2/195.1 |

* cited by examiner

*Primary Examiner*—Katherine M. Moran
(74) *Attorney, Agent, or Firm*—Cislo & Thomas, LLP.

(57) ABSTRACT

A visored headwear is disclosed which has a first visor portion which is operatively associated with the headwear and wherein a second visor overlies the first visor and is positionable in a rearward position relative to the first visor to provide a neck shading.

8 Claims, 2 Drawing Sheets

VERSATILE VISOR CAP

BACKGROUND OF THE INVENTION

Headwear, such as visored caps and clip on type visors have been in ubiquitous use for some time and these caps and headwear, while offering shading for the eyes and the like have been lacking in the ability to allow for protecting the neck portion of the wearer when the need arises.

There have been various suggestions of caps having a pivotal bill and even some with various appurtenances to achieve protection from the sun by various means.

U.S. Pat. No. 5,253,364 directed to a BASEBALL-STYLE CAP HAVING A ROTATABLE BILL, is directed to the baseball style cap which includes a crown portion and a bill that is rotatable about a generally horizontal, rotational axis such that the bill projects outwardly from the crown portion and is repositionable, along the outer periphery of the crown portion, from a forward eye shading position to a rearwardly directed neck shading position.

However, this prior art cap suffers from several deficiencies in that one is not able to shade both the frontal portion of the wearer's head and the rearward portion at the same time.

U.S. Pat. No. 1,677,187 to Libson directed to a SUN VISOR, is directed to a headpiece having a visor front and a detachable visor which, in one position may overlie the front visor and when detached may be positioned in order to shade the neck of the wearer.

Each of these prior art devices suffer in several respects in that either expensive fastening members are required or the headwear themselves do not achieve the attributes that one would desire in a headwear that would provide for having the ability to carry a visor in an unobtrusive manner and yet be able to position it so as to give the shading qualities desired.

Additionally, some of the prior art headwear has not allowed for a visored headwear that has an open crown to allow for the ease of wearing of women's hair affixed in a ponytail or the like.

SUMMARY OF THE INVENTION

In an exemplary embodiment there is disclosed visored headwear comprising the combination of a first visor portion that is operatively associated with the headwear and which is of self supporting material (that is of some rigidity) so that same may act as a shading member. A second visor portion of conformable material, as opposed to the self supporting material, is adapted for twisting and flexing and has a first upper and a second lower surface which is adapted to overlie the first visor portion and is affixed to the visored headwear to allow twisting thereof so that the second lower surface of the second visor portion becomes an upper surface when rearwardly positioned relative to the first visor portion.

That is, in the normal state where shading of the eyes is desired, a visor member is of a sufficient size and configuration is provided in order to allow shading of the eyes. A second visor which is congruently shaped to the first visor is positioned to overlie the first visor and is attached in such a manner, at opposed pivot points, so as to allow the repositioning of the second visor in a rearward or backward fashion and because of the fabric of construction a twisting or turning is permitted so that the second visor may assume a shape of a spherical plane or configuration that is beneficial with respect to shading the neck of the wearer. Yet when the second visor is positioned over the first visor, it lies thereon and is unobtrusive with regard to its placement on the first visor.

In another embodiment of the invention the visored headwear takes the configuration of a snap-on type visor which has an open crown to allow the wearer's hair to freely fall and not be confined by the headwear and still allow the positioning of a second visor to provide shade for the neck of the wearer.

DESCRIPTION OF THE PREFERRED EMBODIMENT(S)

The detailed description set forth below in connection with the appended drawings is intended as a description of exemplary embodiments and is not intended to represent the only forms in which the exemplary embodiments may be constructed and/or utilized. The description sets forth the functions and sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of the invention.

Some embodiments of the invention will be described in detail with reference to the related drawings of FIGS. 1–4. Additional embodiments, features and/or advantages of the invention will become apparent from the ensuing description or may be gleaned by practicing the invention. In the figures, the drawings are not to scale with like numerals of reference referring to like features throughout.

Figure 2:
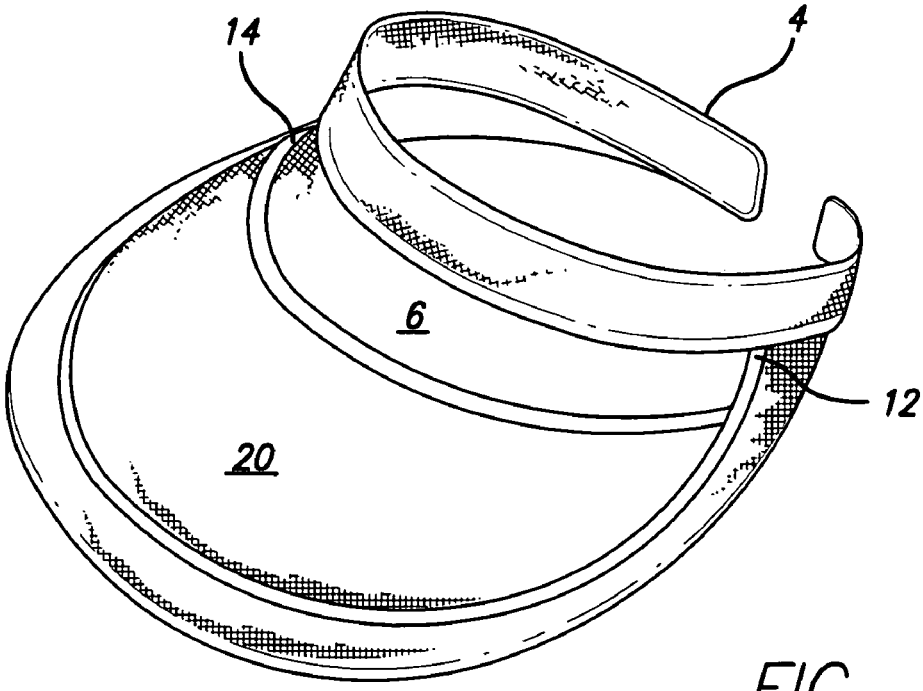
FIG. 2 is a front perspective view of the visored headwear of the invention where the second visor portion is in overlying position to the first visor portion.

Referring to the figures of drawings, there is shown a visored headwear 2 in this particular instance comprising a band portion 4 which may comprise any open-ended elastic or flexible member whether it be of plastic or metal and being arc-like in configuration as best seen in FIG. 2.

Secured to the band portion 4 which is overlaid with a material of one's choosing, whether it be synthetic or natural fiber, there is secured a first visor portion 6 of self-supporting material or somewhat rigid plastic, again being overlaid with a fabric similar to that for the remainder of the visored headwear. It will be noted that the first visor portion 6 is of a configuration and symmetry so as to provide shading for the eyes of the wearer as best seen in FIG. 1.

Figure 1:
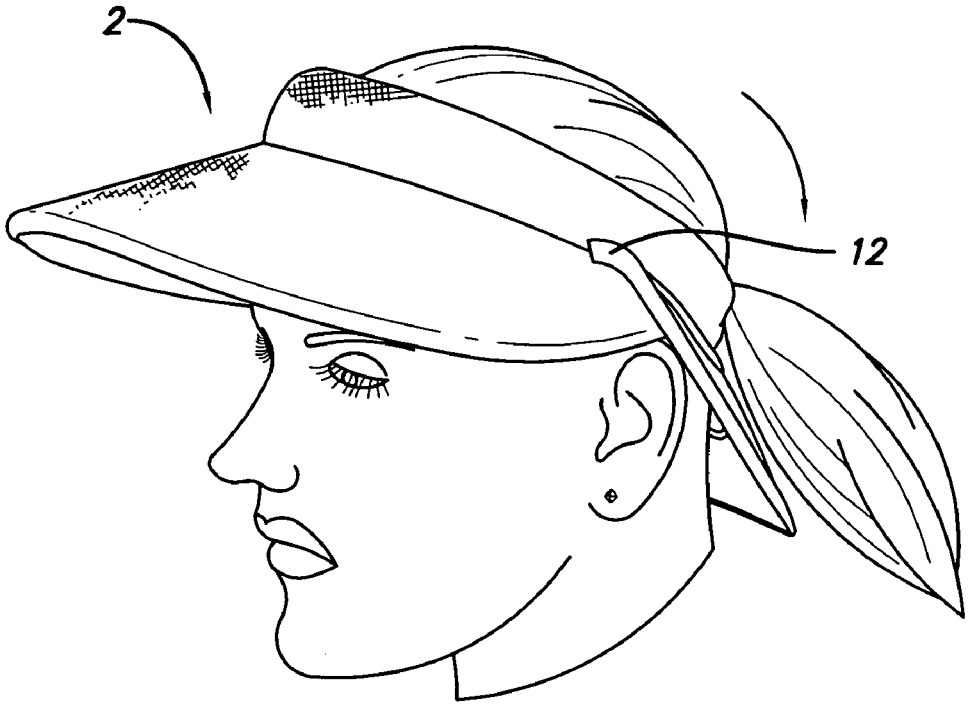
FIG. 1 is a front perspective view of a visored headwear in accordance with an exemplary embodiment of the invention.

Secured at pivot points 8 and 10 by means of tabs of flexible material 12 and 14 is second visor portion 20 congruently shaped to a first visor portion 6 but being of a smaller size and of a conformable or flexible material such that in the position shown in FIGS. 1 and 2 it lies over and conforms to the first visor portion 6 in an unobtrusive fashion.

However, it should be noted that the headwear 2 is in this particular instance crownless thereby allowing the wearer, such as a woman, to have her ponytail hair unencumbered as best seen in FIG. 1.

Figure 4:
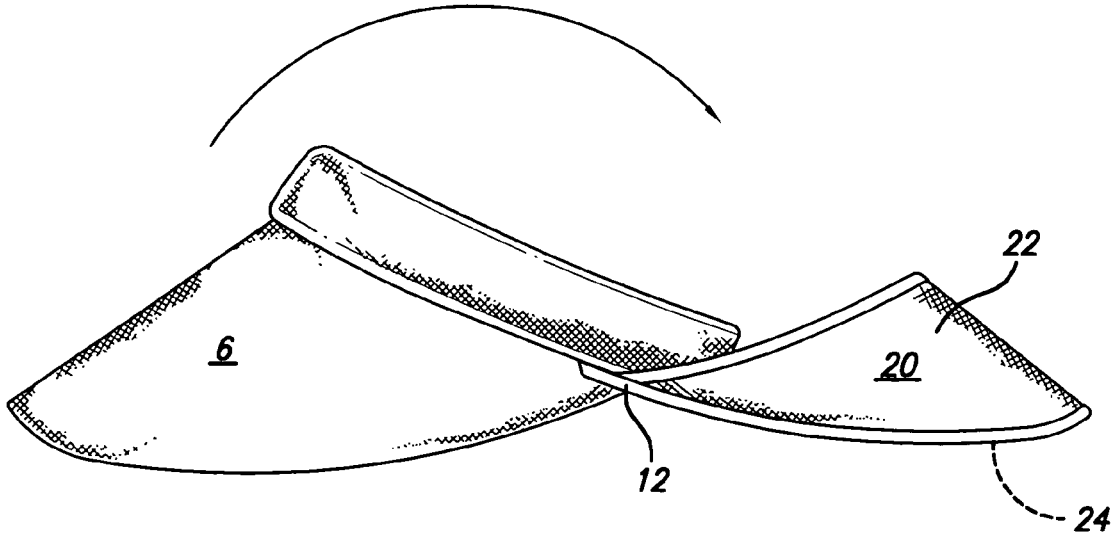
FIG. 4 is a side view of the visored headwear of the invention with the second visor portion being in the neck shading position.

Should the wearer desire to have a neck shade the wearer merely lifts up the second visor portion 20 and rotates the same to the rearward position as seen in FIGS. 1 and 4.

Figure 3:
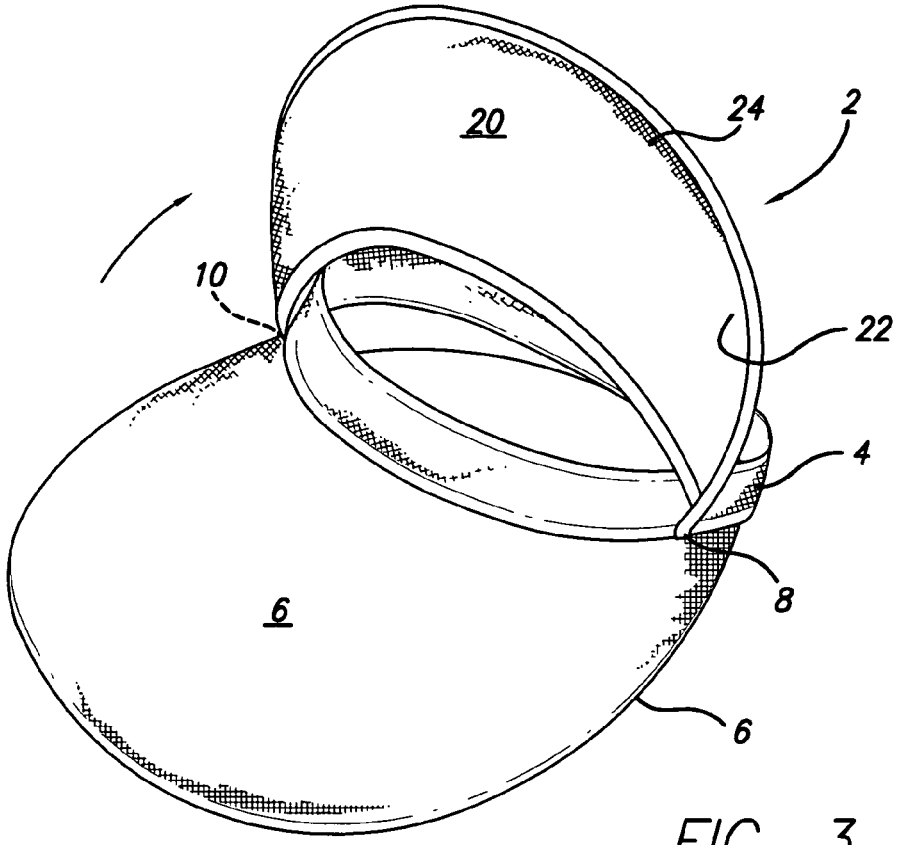
FIG. 3 is a view similar to FIG. 2 but showing the second visor portion being moved rearwardly with a twisting and flexing movement to assume a back shading position as shown in FIGS. 1 and 4.

During the transition from the overlying state of second visor portion 20 relative to first visor portion 6 as best seen in FIG. 3 the conformable fabric allows the visor to be pivotally moved and at the same time to be able to flex in the downward position to achieve what may be considered a downwardly spherical plane which is the reverse of the plane in which the second visor portion 20 was in when it was in the position shown in FIG. 2.

That is, second visor portion 20 has a first lower surface 22 and an upper surface 24. When second visor portion 20 is in the overlying position as seen in FIG. 2 lower surface 22 overlies the upper surface of first visor portion 6. However, when the second visor portion 20 is rotated or pivoted to the rearward position relative to first visor portion 6 the lower surface 22 of second visor portion 20 becomes the upper surface when positioned in the rearward position as seen in FIG. 4.

Thus, when the smaller congruently-shaped second visor portion 20 is in overlying position to first visor portion 6 it is in a normal position in a congruent spherical plane or a similar plane as the first visored portion 6 assumes. However, when the second visor portion 20 is rotated and the conformable material is flexed and twisted, the second visor portion 20 assumes a spherical planar contour reverse of its normal position then when overlying first visor portion 6. To this end the second visor portion 20 is of a material that is somewhat self-supporting as opposed to being flimsy but is nowhere near the self-supporting rigidity or rigidness that would be associated with a preformed plastic material such as that comprising first visor portion 6.

A visored headwear, while being shown as being crownless, the invention would also apply to the ubiquitous baseball cap and those of ordinary skill in the art will of course recognize what minor revisions or modifications would be necessary.

EXAMPLE

A visored headwear is fabricated in accordance with the disclosed invention and is as follows:

Material of construction for first visor: A relatively rigid plastic or synthetic material of about 3–5 mm. in thickness and having a fabric overlay to match or coordinate with the remainder of the headwear.

Material of construction for second visor: A conformable or pliable cloth of about 2–4 mm. in thickness capable of sustaining its shape but not being so thick as to resist being flipped over or allowing its surfaces to be reversed as explained hereinbefore.

Material of construction for headband: Relatively springy metal or plastic being about 6–8 mm. in thickness and having an inner foam layer to cushion against the head of the wearer and wherein a layer of cotton material overlies or covers the same. The cloth overlays are of a light weight brushed cotton and may also be knitted material or mesh and in each case the fabric thickness is about 0.01–0.03 mm.

A person of ordinary skill in the art will appreciate that exemplary embodiments described herein above are merely illustrative of the general principals of the present inventions.

Other modifications or variations may be employed that reside within the scope of the invention.

Thus by way of example but not of limitation, alternative configurations may be utilized in accordance with the teachings herein. Accordingly the drawings and description are illustrative and not to be a limitation thereof.

Moreover, all terms should be interpreted in the broadest possible manner consistent with the context. In particular, the terms and comprising should be interpreted as referring to elements, components or steps in a non-exclusive manner indicating that the referenced elements, components or steps may be present or utilized or combined with other elements, components or steps that are not expressly referenced. Thus, it is intended that the invention cover all embodiments and variations thereof as long as such embodiments and variations come within the scope of the appended claims and their equivalence.

What is claimed is:

1. Visored headwear comprising the combination of:

a first visor portion operatively associated with said headwear and being of self supporting material;

wherein said first visor portion is of rigid material; and a second visor portion of conformable material and adapted for twisting and flexing thereof and having first, upper and second lower surfaces and being adapted to overlie and conform to said first visor portion and being affixed to said visored headwear to allow twisting thereof so the second lower surface of said second visor portion becomes an upper surface when rearwardly positioned relative to said first visor portion, wherein said second visor portion being affixed to said headwear at opposed flexible pivot points;

wherein said second visor portion being congruently shaped to said first visor portion; and wherein said second visor portion is of smaller size than said first visor portion and in a first position overlying said first visor portion assumes a normal position to overlie said first visor portion in a congruent spherical plane.

2. The visored headwear in accordance with claim 1 wherein when said second visor portion is rearwardly positioned said second visor portion assumes a spherical planar contour reverse of its normal position.

3. The visored headwear in accordance with claim 2 wherein spaced flexible tabs comprise said opposed pivot points.

4. The visored headwear in accordance with claim 3 wherein said headwear comprises a substantially elastic headband portion operatively affixed to said first and second visor portions.

5. Visored headwear comprising the combination of:

a first visor portion operatively associated with said headwear and being of self supporting, rigid material;

a second visor portion of conformable material, being congruently shaped to said first visor portion, being adapted for twisting and flexing thereof, having first upper and second lower surfaces, being adapted to overlie and conform to said first visor portion, and being affixed to said visored headwear at opposed flexible pivot points to allow twisting thereof so the second lower surface of said second visor portion becomes an upper surface when rearwardly positioned relative to said first visor portion, said flexible pivot points comprising spaced flexible tabs; and a substantially elastic headband portion operatively affixed to said first and second visor portions;

wherein said second visor portion is of smaller size than said first visor portion and in a first position overlying said first visor portion assumes a normal position to overlie said first visor portion in a congruent spherical plane;

wherein when said second visor portion is rearwardly positioned said second visor portion assumes a spherical planar contour reverse of its normal position; and wherein said elastic headband portion is open ended and arc-shaped in configuration and is of plastic material.

6. The visored headwear in accordance with claim 5 wherein first visor portion is of relatively rigid plastic material and is covered with a covering comprising the same material of construction as said visor portion.

7. The visored headwear in accordance with claim 6 wherein visored headwear is of crownless configuration.

8. The visored headwear in accordance with claim 7 wherein a wearer of said visored headwear is able to shade the eyes with said first visor portion and the neck with said second visor portion.

* * * * *